United States Patent [19]

Calebs

[11] 4,418,915

[45] Dec. 6, 1983

[54] PUZZLE OF STACKED SEGMENTS

[76] Inventor: Robert A. Calebs, 7406 Cross Creek Blvd., Louisville, Ky. 40228

[21] Appl. No.: 387,384

[22] Filed: Jun. 11, 1982

[51] Int. Cl.[3] ..... A63F 9/08

[52] U.S. Cl. ..... 273/159

[58] Field of Search ..... 273/153 R, 155, 159

[56] References Cited

U.S. PATENT DOCUMENTS

| | | | |
|---|---|---|---|
| 510,216 | 12/1893 | Waibel | 273/155 X |
| 514,901 | 2/1894 | Blanchard | 273/159 |
| 543,684 | 7/1895 | Hedenberg | 273/153 R |
| 1,388,710 | 8/1921 | Hime | 273/160 |
| 2,825,178 | 3/1958 | Hawkins | 273/155 UX |
| 3,222,072 | 12/1965 | Dreyer | 273/153 R UX |
| 3,550,309 | 12/1970 | Vennola | 273/159 X |
| 4,015,852 | 4/1977 | Gibson | 273/159 X |

*Primary Examiner*—Anton O. Oechsle

*Attorney, Agent, or Firm*—Richard L. Caslin

[57] ABSTRACT

A puzzle is shown having a stack of hollow segments that are joined together so that each segment is adapted to be turned about a longitudinal axis of the stack. Each hollow segment has certain side walls that include a hole formed therein, and some of the hollow segments have either top and/or bottom walls with one or more holes formed therein. All of the holes in the side walls are visible at all times, while the holes in either the top or the bottom walls of the hollow segments are generally only visible when adjacent segments are arranged out of alignment with each other. This puzzle is furnished with a separate flexible connection that is adapted to be threaded through certain of the holes, but only one time therethrough. The START hole is unknown to the first time prolem solver. Only such holes as are visible from the exterior of the puzzle need be furnished with the flexible connection threaded therethrough. The object of the puzzle is to complete the objective of the puzzle without running out of the necessary length of the flexible connection.

15 Claims, 8 Drawing Figures

FIG. 3
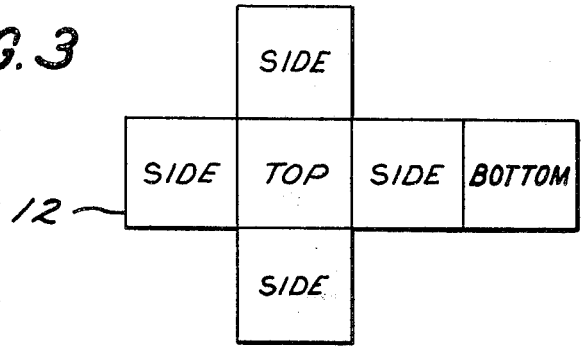
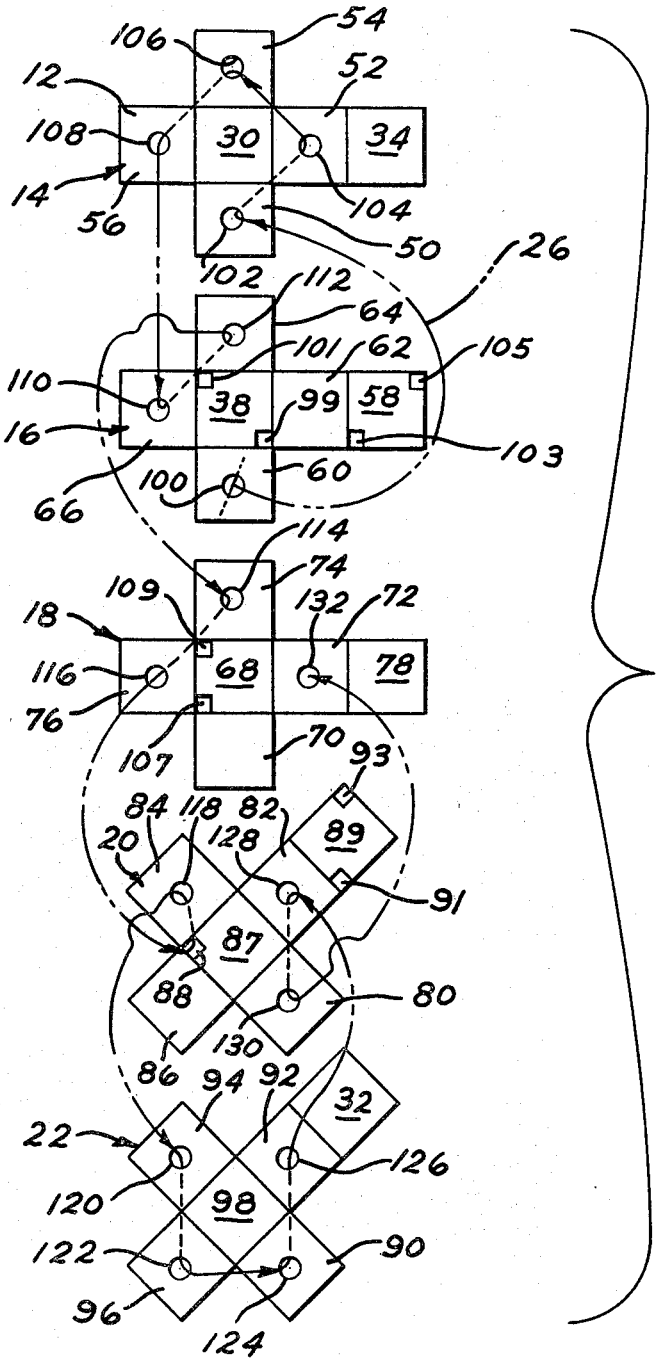
FIG. 4

PUZZLE OF STACKED SEGMENTS

BACKGROUND OF THE INVENTION

1. Field of the Invention

This invention relates to the art of puzzles, toys or games for entertainment purposes and the sharpening of mental skills. This invention relates to a design of a puzzle comprising a plurality of blocks or cubes having a plurality of openings, where the blocks may be turned relative to each other for aligning the openings in a plurality of arrangements. The objective is to take a string or flexible member of a given length and run it through the openings, but only once, while at the same time including all openings without using up the string before the objective is completed.

2. Description of the Prior Art

The prior art is full of very old patents that relate to puzzles that are only remotely related to the present invention.

The Barry U.S. Pat. No. 234,223 is over 101 years old. This Barry device is a combination puzzle and game that has a short rod with a stationary handle at one end, and four short cylinders positioned on the rod. These cylinders have alternate numbers and letters formed thereon in such an order that when the cylinders are turned in a particular position, the sum of the various columns of numbers will be the same, and the various columns of letters will spell words. There is no string associated with this device, nor are there any holes through which a string would be threaded.

The Trumbull U.S. Pat. No. 438,661 issued about 91 years ago. This patent relates to a series of balls or blocks which are threaded loosely on a cord and bearing numbers, letters or other indicia. The objective to be reached is to transpose the order in which the balls, blocks or objects follow one another without removing them or any of them from the cord.

The Blanchard U.S. Pat. No. 514,901 relates to a puzzle comprising a frame having two upright sides and three crossbars arranged therebetween. Each of the crossbars is made with a cord passage at each end, and these cord passages are in alignment. A cord having a threading needle at one of its ends and a ball at the other is adapted to be passed up through the bars, and an intermediately-placed disk or button between the bottom and middle bar and between the latter and the top bar at each side of the frame. The solution of the puzzle consists in so threading the cord back and forth through the cord passages and those in the bars, as to bring the disk into the position below the bottom bar on the cord above the ball.

The Hedenberg U.S. Pat. No. 543,684 relates to a puzzle which can serve to portray the game of football or the positions of the opposing teams when ready for play, and the object of the invention is to permit or cause a flexible connection, such as a cord, to be passed in a certain order through, under, or around a series of holes or projections which represent the men on the football field, and thence to a certain point representing a "goal." The length of the connection or cord is just sufficient to enable the cord to reach the goal point when passed in proper order through and around said holes or projections.

The Favour U.S. Pat. No. 658,083 describes a game board which represents a house plan having a number of rooms with front and back porches. A burglar is assumed to have entered the house from the front porch and emerged on the back porch, having visited each room but once, always passing through the doors. The problem is to outline the route of the burglar through the building, and for this purpose a cord is provided and pins are placed in the centers of the rooms around which the cord may be passed.

The Hime U.S. Pat. No. 1,388,710 describes a puzzle comprising a plurality of interlocking blocks that have central notches and tongues which, when properly associated, produce a structure that forms a Chinese cross. The primary object of this Hime invention is to connect each of the blocks constituting the elements of the puzzle by a flexible member or cord. This cord serves to prevent the displacement or loss of any of the blocks, and it also serves as a means for perplexing and rendering more intricate the assemblage of the blocks and adds to the skill and patience as well as the amusement of the operator.

OBJECTS OF THE PRESENT INVENTION

The principal object of the present invention is to provide a puzzle where a separate flexible connection is threaded through certain holes in the walls of a plurality of hollow segments in such a way that all of the visible holes are provided with the flexible connection extending therethrough, while none of the non-visible holes are provided with the flexible connection extending therethrough.

A further object of the present invention is to provide a puzzle of the class described where the hollow segments are movable with respect to each other, but they remain together in a stacked condition at all times.

A further object of the present invention is to provide a puzzle of the class described wherein it is necessary to find a certain unknown START hole before it is possible to solve the puzzle.

A further object of the present invention is to provide a puzzle of the class described where it is not possible to capture the flexible connection between adjacent top and bottom walls of adjacent hollow segments.

A still further object of the present invention is to provide a puzzle having a stack of hollow segments that are fastened together and are rotatable with respect to each other and have holes in certain walls thereof so that a separate flexible connection may be threaded through the holes so that when viewed from all sides of the puzzle, all holes which are visible will have the flexible connection passing therethrough, but one time only.

SUMMARY OF THE INVENTION

The present invention provides a puzzle having a series of hollow segments that are used in combination with a separate flexible connection. The series of segments are arranged in a unitary stack, and adjacent segments are joined together about a longitudinal axis of the stack so that each segment is capable of being turned with respect to the others. Each segment has certain walls which are formed with a hole therethrough. All of the holes in the side walls of the segments are visible at all times, while the holes in the top and bottom walls of certain of the segments are only visible when adjacent segments are turned out of alignment with each other. The objective or solution of the puzzle is to thread the flexible connection through the holes of the hollow segments so that all of the visible holes are furnished with the flexible connection extending therethrough, but the flexible connection may not pass through any one hole more than once. It is the object of this invention to solve this puzzle without running out of the necessary length of the flexible connection in order to accomplish the objective.

BRIEF DESCRIPTION OF THE DRAWINGS

This invention will be better understood from the following description taken in conjunction with the accompanying drawings, and its scope will be pointed out in the appended claims.

FIG. 3 is a diagrammatic layout, in top plan view, of a single hollow segment in the shape of a block or cube, so that the walls of the block may be identified to assist in the detailed description of the complete invention in the following Figure.

FIG. 4 is a diagrammatic layout of each of the five blocks of the puzzle showing the disposition of the holes in certain side walls and certain top and bottom walls of the blocks, as well as showing the path of the flexible connection beginning at the START hole 100 (which is unidentified and unknown to the first time problem solver), and following a certain path by being threaded through each visible hole but once, and arriving at the FINISH hole 132 (likewise unidentified) before running out of the fixed length of the flexible connection and thereby successfully solving the puzzle. Note that dash lines denote hidden lines of the flexible connection within the segment, while broken lines are phantom lines of direction that do not denote lines of a precise length of the flexible connection.

DESCRIPTION OF THE PREFERRED EMBODIMENTS

Figure 1:
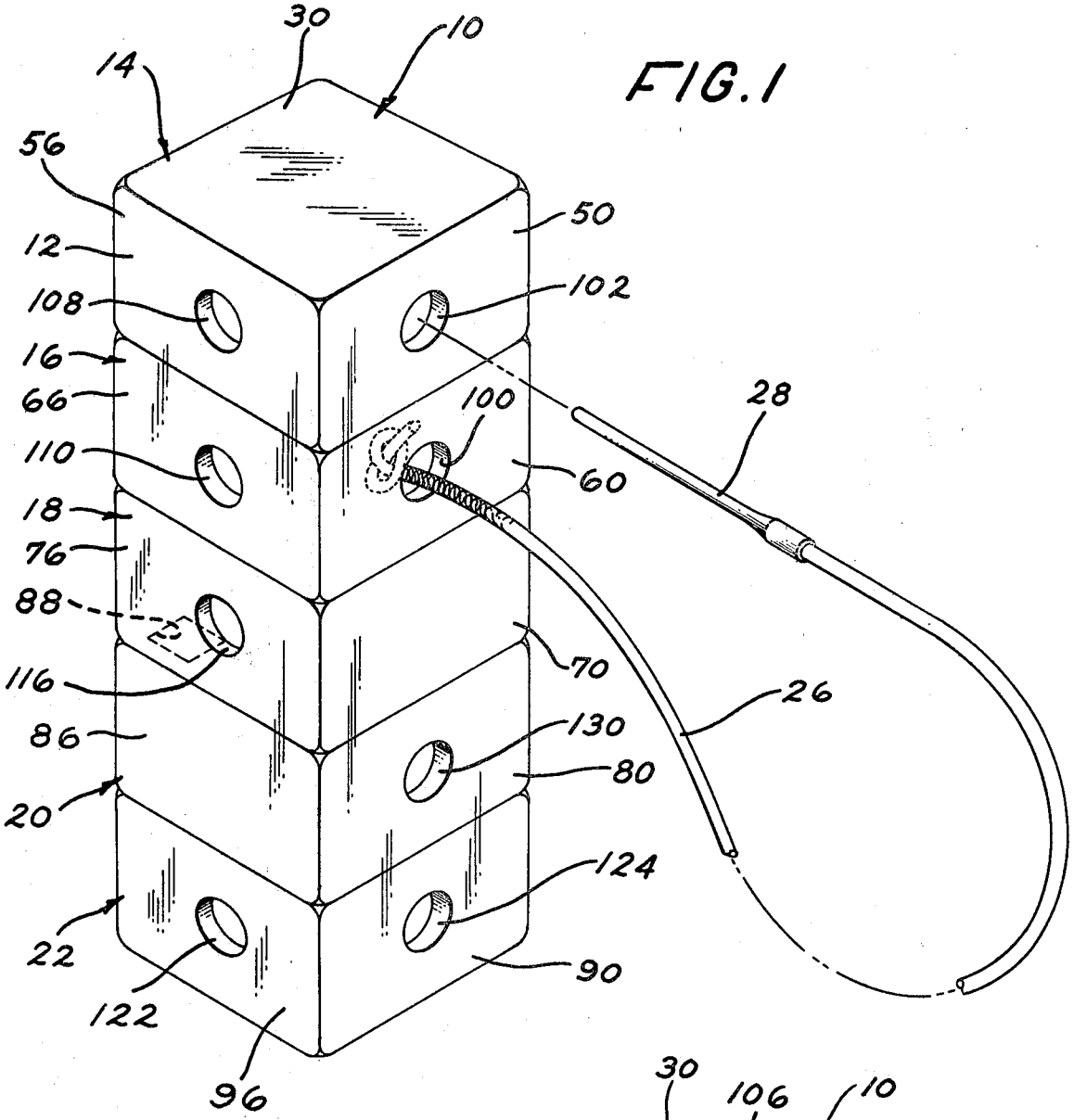
FIG. 1 is a top perspective view of a puzzle embodying the present invention and having a series of hollow rotatable segments stacked together in combination with a separate flexible connection of a predetermined length. This view shows the puzzle in its starting condition before it has been solved.

Turning now to a consideration of the drawings, and, in particular, to the top perspective view of FIG. 1, there is shown a puzzle 10 that comprises a series of hollow segments 12, which are shown as five in number, and, counting from the top, identified as top block 14, topmost intermediate block 16, central intermediate block 18, bottommost intermediate block 20, and bottom block 22. It should be understood at the outset that this puzzle invention may have more or less than the five blocks without departing from the present invention. Moreover, the hollow segments 12 need not be shaped in the form of a cube or block. They may be triangular blocks, as viewed from the top, or the blocks could have slightly concave side walls, as viewed from the top. The term hollow segment has been chosen as a generic term for such elements which will serve in the practice of the present invention. An important element of the puzzle invention of the present invention is a separate flexible connection 26, which is in the form of a cord or string of a carefully measured length in view of the dimensions of the various components of this invention, so that when the puzzle is solved, the length of the flexible connection will be just exactly the correct dimension in order to reach the solution to the puzzle by extending between the START and the FINISH holes. Notice that the leading end of the flexible connection 26 is provided with a more rigid needle-like portion 28. This needle-like portion 28 is not a metallic rigid member, but it is semi-rigid, so that it is convenient to thread the needle portion 28 into a hole of a hollow segment 12 and come out an adjacent hole without having any difficulty in losing the leading edge of the flexible connection and having to withdraw the connection and try again. The tail end of the separate flexible connection 26 is shown with a loose knot, but this knot does not lock or fasten the connection in the hole 100. This knot merely serves as a temporary anchor.

Figure 8:
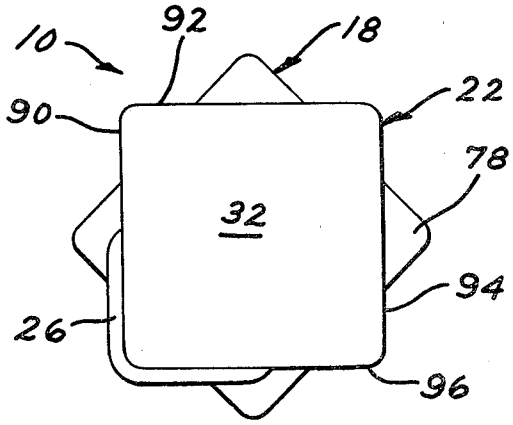
FIG. 8 is a bottom plan view of the solved puzzle of FIG. 5.

In the preferred embodiment, as shown in FIG. 1, all of the five blocks are of the same overall configuration, although it should be understood that it is possible to provide a stack of hollow segments which are of different sizes and shapes without departing from the present invention. Notice that the top wall 30 of the top block 14 is imperforate. Also, the bottom wall 32 of the bottom block 22, shown in FIG. 8, is imperforate. Again, this is the preferred embodiment, to have the top and bottom walls imperforate, but they could include a hole without departing from the present invention.

Figure 2:
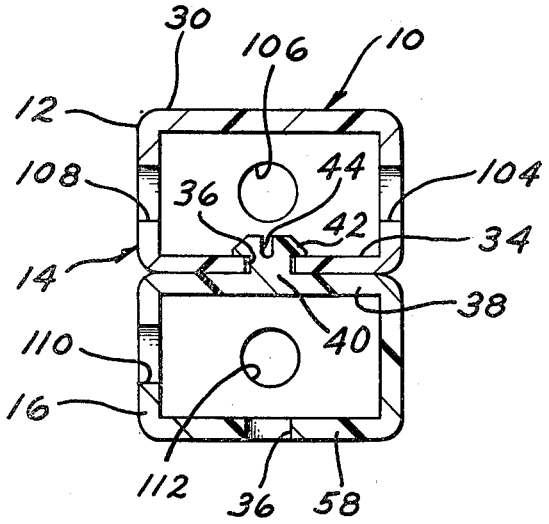
FIG. 2 is a fragmentary, cross-sectional, elevational view through the center of the first two top segments of the stack of hollow segments to show the nature of the pivotal connection between adjacent segments so that the segments are capable of turning with respect to each other along a longitudinal axis extending up through the stack.

FIG. 2 is a fragmentary, cross-sectional, elevational view through the center of the top two segments 14 and 16, and its purpose is to show the preferred method of attaching adjacent segments together. The top segment 14 has a bottom wall 34 with a central opening 36, while the adjacent segment 16 has a top wall with an upwardly-extending post 40 located at its center for extending through the mating central opening 36 of the bottom wall 34. The top portion of the post 40 is furnished with an enlarged, tapered head 42. A central cavity 44 is formed down into the post from the top so that this enlarged, tapered head 42 is compressible when the post 40 is inserted into the opening 36. Once the post is fully inserted, the enlarged, tapered head will return to its normal size, and thereby engage the top surface of the bottom wall 34 and serve to lock the post 40 in the opening 36 and prevent the adjacent segments 14 and 16 from being inadvertently separated, while at the same time allowing the adjacent blocks 14 and 16 to rotate with respect to each other around the longitudinal vertical axis of the post 40, which also is the longitudinal central axis of the stack of hollow segments 12. As will be understood by those skilled in this art, probably the best material for forming the hollow segments is a molded thermoplastic material of pleasing colors, either mixed or matched, which are widely used in the toy and game arts at the present time. It is conceivable that different puzzles needing different sizes or lengths of flexible connections 26 could be arranged by altering the relative dispositions of the various hollow segments 12, or perhaps adding additional segments or subtracting from the number of segments. While one preferred method of attaching the adjacent segments together is shown in FIG. 3, it will be understood that other methods of assembly are available, as, for example, using a longitudinal bolt (not shown) that would extend from the top block 14 through the three intermediate blocks and terminate within the bottom block 22. This bolt would be provided with a suitable nut or fastener (not shown) for holding the stack of segments together.

Turning now to a consideration of the diagrammatic layout view of FIG. 3, a typical hollow segment 12 is shown in one embodiment as being a block or cube that has six sides that are generally equal in size to each other, and each wall of the block is labeled as to whether it is a side wall or whether it is a top or bottom wall.

Now, turning to the diagrammatic layout of the entire puzzle 10 of FIG. 4, each hollow segment 12 is formed in a plan view so that each characteristic of each segment can be viewed all at one time. The blocks are arranged in the same order as they are arranged in the stack of FIG. 1. Since the central openings 36 of the bottom wall of the segments 14, 16, 18 and 20 do not cooperate with the flexible connection 26, they are not illustrated in the diagrammatic layout of FIG. 4. By the same token, the mating post 40 of the adjacent segments are not illustrated in FIG. 4. The main purpose of FIG. 4 is to illustrate the successful solution to the puzzle 10.

Continuing in the explanation of the invention by use of FIG. 4, the top block 14 has a top wall 30 and a bottom wall 34, both of which are imperforate. Moreover, this top block 14 has four side walls 50, 52, 54 and 56.

Since there are three blocks 16, 18 and 20 that are intermediate the top block 14 and the bottom block 22, these three intermediate blocks are so designated. Block 16 is the topmost intermediate block, and it has a top wall 38 and a bottom wall 58; it being understood that the central opening 36 for receiving the post 40 is not considered as a hole for receiving the flexible connection 26, and therefore is ignored in the explanation of the solution to the puzzle in FIG. 4. This block 16 has four side walls 60, 62, 64 and 66.

The central intermediate block 18 has a top wall 68, four side walls 70, 72, 74 and 76, and a bottom wall 78 that is imperforate.

The bottommost intermediate block 20 has four side walls 80, 82, 84 and 86. This block 20 has a top wall 87 which has a single corner hole 88. The bottom wall 89 has two diagonally-opposite corner holes 91 and 93.

The bottom block 22 has four side walls 90, 92, 94 and 96. This block 22 has both a top wall 98 and a bottom wall 32 which are imperforate.

Certain top and bottom walls contain corner holes, and they will now be identified. Topwall 38 of block 16 has two diagonally-opposite corner holes 99 and 101. The bottom wall 58 of block 16 has two other diagonally-opposite corner holes 103 and 105. In block 18, the top wall 68 has two adjacent corner holes 107 and 109.

Figure 5:
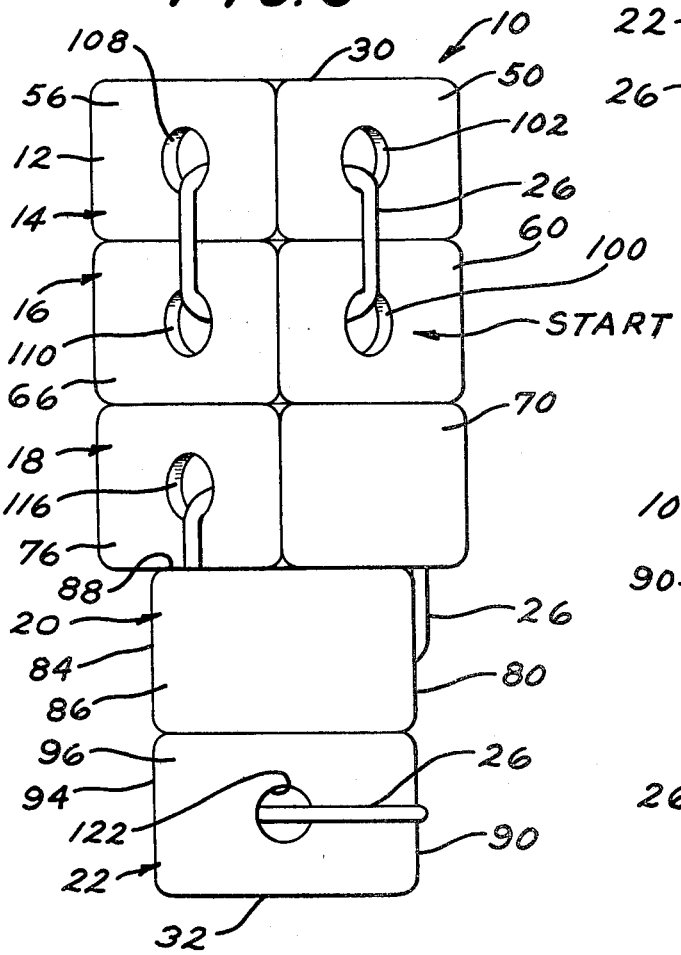
FIG. 5 is an elevational view of the puzzle of the present invention after it has been solved, showing the three top segments in square alignment, and the two bottom segments in alignment with each other, but turned out of alignment with the three top segments by about 45°.

As has been stated above, certain of the side walls of the hollow segments 12 are provided with a hole, and all of these holes are visible on the exterior of the puzzle, and they therefore must be furnished with the flexible connection 26 extending through each hole in a side wall but once. The path of the flexible connection 26, as it is threaded through the holes of the blocks of the puzzle, will be identified in generally consecutive order, starting with the unknown and unidentified START hole 100 in side wall 60 of the topmost intermediate block 16. When the flexible connection 26 is on the exterior of the puzzle, it will be shown in full lines, and when it is within the hollow segment 12, it will be shown in dotted lines. From START hole 100, as is best seen in FIGS. 1, 4 and 5, the cord 26 next enters hole 102 in the side wall 50 of the top block 14. It should be understood by those skilled in this art that it is best to thread the cord 26 through an opening which is the shortest distance from the hole being left so as not to waste the length of the cord 26. Next, the cord travels within the top block 14 from the hole 102 to the hole 104 in the side wall 52. Then the cord travels on the outside of the block 14 from hole 104 to hole 106 in side wall 54. Then the cord travels within the block 14 from hole 106 out through hole 108 in side wall 56.

Then the cord is brought from the top block 14 to the topmost intermediate block 16 and passes through a hole 110 in the side wall 66. Then the cord 26 travels within the block 16 from hole 110 out through hole 112 in side wall 64.

Now the cord leaves the block 16 and passes to the central intermediate block 18 on the exterior of the blocks until it enters hole 114 in side wall 74. A reminder is made that while this diagrammatic layout drawing of FIG. 4 shows the string 26 as a broken line in phantom view taking a wide arc from one block to the next, that in actual practice the cord is made to travel the shortest distance from one hole to the next in order to accomplish the desired result and solve the puzzle. The reason that the diagrammatic showing uses wide-ranging arcs is to avoid confusing or complicating the showing of the block layouts. This point can be understood by noticing in the top perspective view of FIG. 1 that the string moves in a vertical direction from hole 100 in side 60 to hole 102 in side 50. In a similar manner, the cord moves in a straight vertical direction from hole 108 in side 56 to hole 110 in side 66.

Figure 6:
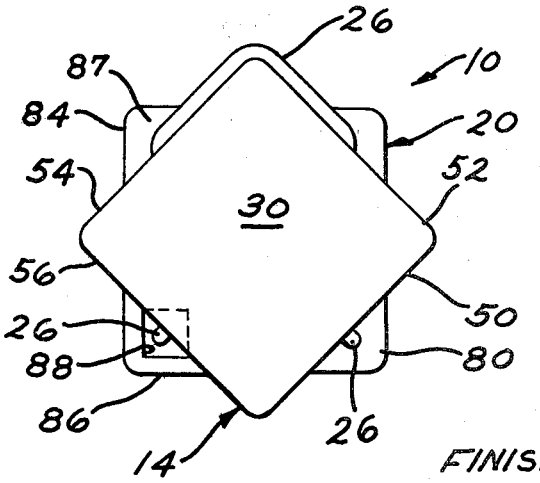
FIG. 6 is a top plan view of the solved puzzle of FIG. 5 showing the flexible connection extending down into the corner hole in the top wall of the bottom block of the three intermediate blocks.

Then the cord travels within the central intermediate block 18 from hole 114 out through hole 116 in side wall 76. Notice that up to now the three topmost blocks 14, 16 and 18 are squarely aligned with each other, as is clear from FIGS. 4, 5 and 7. Below that point, this condition changes as the two lower blocks 20 and 22 are squarely aligned with each other, but turned out of alignment with the top three blocks 14, 16 and 18 by about a 45 degree angle. This condition exposes the single corner hole 88 in the top wall 87 of the lowermost intermediate block 20, as is clear from both FIGS. 5 and 6. Thus, the cord 26 travels down from the central intermediate block 18 to the bottommost intermediate block 20 and enters the top corner hole 88, as is best shown in FIGS. 4, 5 and 6. Then the cord travels only a short distance within the block 20 from hole 88 out through hole 118 in side wall 84.

Then the cord travels from the bottommost intermediate block 20 on the exterior of the puzzle down to the bottom block 22, and it enters hole 120 in side wall 94 and travels within this block 22 and exits through hole 122 in side wall 96.

Then it travels on the outside of block 22 and enters the hole 124 in side wall 90. Then it travels within block 22 and exits through hole 126 in side wall 92.

Then it travels on the outside of the puzzle from block 122 up to the bottommost intermediate block 20 and enters hole 128 in side wall 82. Then it travels within block 20 and exits through hole 130 in side wall 80.

Figure 7:
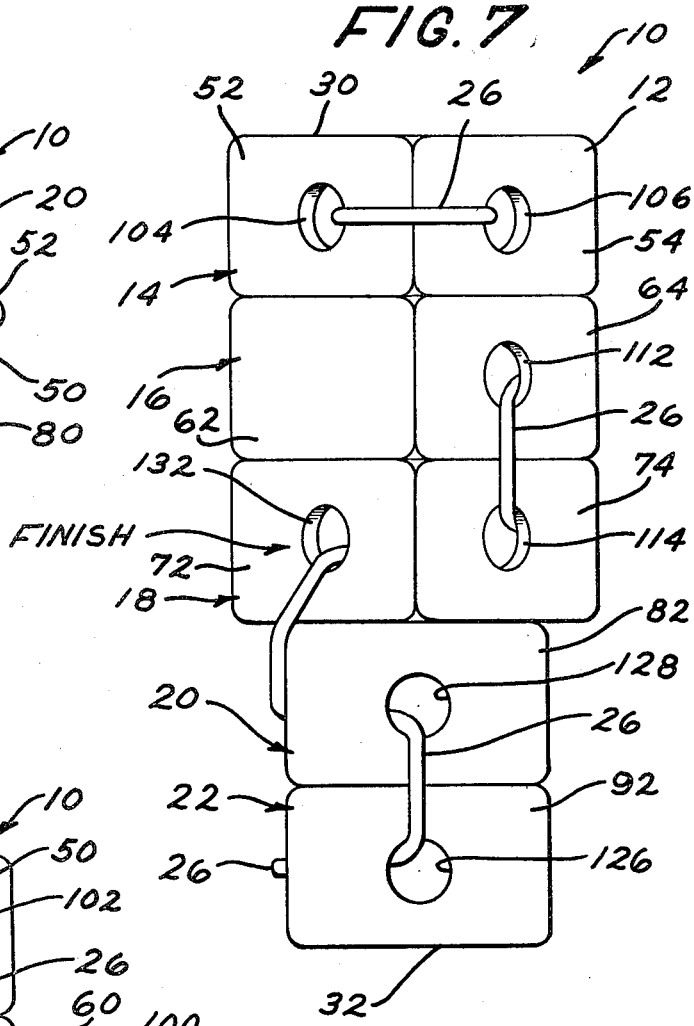
FIG. 7 is a rear elevational view of the solved puzzle of FIG. 5.

There is only one other move from this point, and that is to travel from block 20 to the central intermediate block 18 on the outside of the puzzle and enter hole 132 of side 72 which is the FINISH hole 132, as is seen in FIG. 7.

In order to summarize the above moves, a shorthand version of the moves will now be tabulated. The correct but unidentified START hole is hole 100 in block 16, and by an exterior path to hole 102 in block 14. Then an interior path to hole 104, then an exterior path to hole 106, and then an interior path to hole 108, all in block 14.

Then the cord leaves block 14 and enters block 16 through hole 110, and by an interior path exits from hole 112 of block 16 and then takes an exterior path from block 16 to block 18 and enters hole 114, and then by an interior path exits from hole 116, and then leaves block 18 and by an exterior path enters block 20 through the top corner hole 88, and then takes a short interior path and exits through hole 118, and then leaves block 20 and by an exterior path enters block 22 through hole 120.

Then by an interior path exits from hole 122, and then by an exterior path enters hole 124, and then by an interior path exits through hole 126 and then leaves block 22.

Next, the cord leaves block 22 and by an exterior path enters block 20 through hole 128, and then by an interior path exits through hole 130, and then takes a final move by an exterior path back to the central intermediate block 18 and enters the FINISH hole 132, as is seen in FIGS. 4 and 7.

Having described above a novel invention of a puzzle comprising a stack of hollow segments in combination with a separate flexible connection, it will readily be apparent that the object of the invention is to thread the flexible connection or cord through the holes provided in the hollow segments of the entire stack of segments one time only without running out of the length of the cord or trapping the cord between twisted segments or blocks. It is well to hold one's thumb over the cord during the threading of a couple of holes. The clearance between adjacent blocks is meant to be kept small so that it is not possible to pass the cord through a corner hole in either a top wall or a bottom wall of a block and then to turn the blocks to be in square alignment. A person operating this puzzle will naturally examine all characteristics of the puzzle prior to starting the threading operation. The person will note the obvious holes in the side walls of the segments or blocks and will also be surprised by the additional openings in the top and bottom walls of some of the segments which are made visible by twisting the blocks in either direction. When the puzzle is correctly solved, it will be possible to look at the stack of segments from any angle and all holes which are visible will have the cord passing through each, but one time only. It is understood that different placement of holes can be made using the same length cord or different length cords without departing from the scope of the present invention.

Modifications of this invention will occur to those skilled in this art. Therefore, it is to be understood that this invention is not limited to the particular embodiments disclosed, but that it is intended to cover all modifications which are within the true spirit and scope of this invention as claimed.

What is claimed is:

1. A puzzle having a series of hollow segments in combination with a separate flexible connection comprising:

a. the series of hollow segments being arranged in a unitary stack and having assembly means joining the segments together about a longitudinal axis of the stack so that each segment is adapted to be turned about this longitudinal axis;

b. each hollow segment having certain side walls thereof formed with at least one hole, certain of the top and bottom walls of the segments having at least one corner hole;

c. all of the holes in the said side walls being visible on the exterior of the puzzle at all times, while the holes of the top and bottom walls are visible after turning adjacent segments relative to each other to expose certain of the said corner holes;

d. the flexible connection being adapted to be threaded in a particular order through certain of said holes one time only, so that all visible holes in the segments are traversed by the flexible connection without running out of the necessary length of the flexible connection in order to solve the puzzle correctly.

2. The puzzle as is recited in claim 1, wherein the said top and bottom segments have the same configuration with the same pattern of holes, but they are inverted relative to each other.

3. The puzzle as is recited in either claims 1 or 2, wherein one of said segments is the START segment, and it has only three of its side walls with a hole in each, one of said holes being a START hole that is unidentified.

4. The puzzle as is recited in either claims 1 or 2, wherein one of said segments is the FINISH segment, and it has only three of its side walls with a hole in each, one of said holes being a FINISH hole that is likewise unidentified.

5. The puzzle as is recited in either claims 1 or 2, wherein one of said segments is the START segment, and it has only three of its side walls with a hole in each, one of said holes being a START hole, while one of said segments that is not the START segment is the FINISH segment, and it has only three of its side walls with a hole in each, one of said holes being a FINISH hole.

6. The puzzle as is recited in either claims 1 or 2, wherein at least one of the segments that is intermediate the top and bottom segments has a top wall with one corner hole while the nearest segment above that top wall has a bottom wall that is imperforate.

7. The puzzle as is recited in claim 2, wherein there are at least three intermediate segments between the top and bottom segments, both the top and bottom segments having a hole in each of four side walls, the topmost intermediate segment having both its top wall and its bottom wall each with two corner holes, the central intermediate segment having a top wall with two corner holes and its bottom wall is imperforate, and the bottommost intermediate segment having a top wall with one corner hole, and its bottom wall has two corner holes.

8. The puzzle as is recited in claim 7, wherein the topmost intermediate segment is the START segment, and a hole in one of its side walls is the START hole, while the central intermediate block is the FINISH segment, and a hole in one of its side walls is the FINISH hole.

9. The puzzle as is recited in claim 8, wherein the said flexible connection is threaded from the said START hole to the top segment and through the holes in four side walls thereof, then to the topmost intermediate segment and through the holes in two side walls thereof, then to the central intermediate segment and through the holes in two side walls thereof, then to the bottommost intermediate segment through a corner hole in the top wall thereof and out through a hole in a side wall thereof, then through the holes in four side walls of the bottom segment, then through the holes in two side walls of the bottommost intermediate segment, and finally to the said FINISH hole in the central intermediate segment, thus using up the entire length of the flexible connection in the successful solution of the puzzle.

10. The puzzle as is recited in claim 9, wherein the said segments are hollow blocks, and the three topmost blocks are squarely aligned with respect to each other, while the two bottommost blocks are squarely aligned with respect to each other, but are out of alignment with the said three topmost blocks so as to uncover the corner hole in the top wall of the bottommost intermediate block, whereby this adjusted configuration is the single proper alignment necessary for the successful solution of the puzzle.

11. The puzzle as is recited in claim 10, wherein the said longitudinal assembly means joining the blocks together comprises a hole in either a top or a bottom wall of one block and a compressible interlocking member on an abutting wall of an adjacent block for mating engagement therebetween.

12. The puzzle invention as is recited in claim 11, wherein the said corner holes in the top and bottom walls of the topmost intermediate block, as well as the said corner holes in the top wall of the central intermediate block, as well as the said corner holes in the bottom wall of the bottommost intermediate block, are all hidden from view when the said flexible connection is threaded through the correct order of holes in the blocks for solving the puzzle.

13. The puzzle as is recited in claim 12, wherein the clearance space beteen adjacent blocks is reduced so that the said flexible connection is not capable of being captured between the top and bottom walls of adjacent blocks.

14. The puzzle as is recited in claim 13, wherein the said flexible connection is a cord having sufficient firmness to pass through the holes in adjacent walls of the said hollow blocks.

15. The puzzle as is recited in any one of claims 1, 2, or 7–14, wherein each said hollow segment is generally cubical in shape and is formed of thin exterior walls, and all of the said holes are generally of the same size, the said holes in the side walls of the segments being generally centrally located.

* * * * *